US007526922B2

(12) United States Patent
Abras

(10) Patent No.: US 7,526,922 B2
(45) **Date of Patent: *May 5, 2009**

(54) HEAT EXCHANGER FOR HIGH PURITY AND CORROSIVE FLUIDS

(75) Inventor: Alexei D. Abras, Livermore, CA (US)

(73) Assignee: Applied Integrated Systems, Inc., Livermore, CA (US)

( * ) Notice: Subject to any disclaimer, the term of this patent is extended or adjusted under 35 U.S.C. 154(b) by 544 days.

This patent is subject to a terminal disclaimer.

(21) Appl. No.: 10/864,739

(22) Filed: Jun. 9, 2004

(65) Prior Publication Data

US 2004/0221585 A1 Nov. 11, 2004

Related U.S. Application Data

(62) Division of application No. 10/365,020, filed on Feb. 12, 2003, now Pat. No. 6,804,965.

(51) Int. Cl.
*F25B 21/02* (2006.01)
*F25D 11/00* (2006.01)
*F28D 7/02* (2006.01)

(52) U.S. Cl. ..... 62/3.7; 62/430; 165/164

(58) Field of Classification Search ..... 62/430, 62/434, 435, 3.7; 165/164, 156
See application file for complete search history.

(56) References Cited

U.S. PATENT DOCUMENTS 2,515,835 A * 7/1950 Preston ..... 137/341
3,726,107 A * 4/1973 Hintze ..... 62/499
3,898,428 A * 8/1975 Dye ..... 392/489
4,161,214 A * 7/1979 Wendel ..... 165/172
4,593,182 A * 6/1986 Schwarzkopf ..... 219/544
6,571,564 B2 * 6/2003 Upadhye et al. ..... 62/3.3
6,804,965 B2 * 10/2004 Abras ..... 62/3.7

* cited by examiner

*Primary Examiner*—William C Doerrler
(74) *Attorney, Agent, or Firm*—Henneman & Associates, PLC; Larry E. Henneman, Jr.

(57) ABSTRACT

A heat exchange apparatus (10, 10, 10*b*) for selectively heating and/or cooling a process fluid (38). A process fluid tubing 14 is wrapped around a primary thermally conductive cylinder (12) having a spiral groove (24) therein adapted for closely accepting the process fluid tubing (14) and increasing the area in thermal contact therebetween. The process fluid tubing (14) is a generally chemically inert tubing. The spiral groove (24) supports the process fluid tubing (14) such that the process fluid tubing (14) can be bent in a radius smaller than the natural minimum bend radius of the process fluid tubing (14). Various embodiments have a cooling apparatus (26, 26*a*) for cooling the process fluid (38). The cooling apparatus (26, 26*a*) has a outer thermally conductive cylinder (16) or an outer thermal reservoir (50) cooled alternatively by coolant fluid (44) passing through cooling fluid tubing (18), by a plurality of thermoelectric modules (54), or by a combination thereof.

49 Claims, 6 Drawing Sheets

12
24
14
14
14
22

12
22
21
15
18
20
16
14
38
42
18
44
48
46
14
40
10

HEAT EXCHANGER FOR HIGH PURITY AND CORROSIVE FLUIDS

RELATED APPLICATIONS

The present application is a divisional of U.S. patent application Ser. No. 10/365,020, filed Feb. 12, 2003 now U.S. Pat. No. 6,804,965 by the same inventor, which is incorporated herein by reference in its entirety.

TECHNICAL FIELD

The present invention relates generally to a heat exchanger device, and more particularly to a novel compact heat exchanger design configuration using polymeric tubing. The predominant current application for the inventive heat exchanger apparatus is for the temperature control of high purity and/or corrosive fluids.

BACKGROUND ART

Many industries require the use of heat exchangers to regulate the temperature of high purity and/or corrosive fluids. For example, microchip fabrication within the semiconductor industry requires heating and temperature regulation of the etching and/or cleaning fluids used to etch and/or clean silicon wafers and microcircuit lines. Because both the process temperatures and the heat capacities of the etching/cleaning fluids are relatively high, a rather large amount of heat is required to raise and maintain the temperature of the etching/cleaning fluid.

Due to the corrosive nature of the typical etching/cleaning fluids used in the semiconductor industry, common materials traditionally utilized in the fabrication of heat exchangers such as metals are not chemically compatible, and therefore, are unacceptable. While metals are extremely good thermal conductors, they are chemically attacked when exposed to these corrosive fluids. As a result, the fluid becomes contaminated and can no longer be used as an etching/cleaning agent.

In order to solve this limitation, a chemically inert material such as Teflon™ is used to either carry the fluid or to protect the resistive element from being corroded, as in the case of an immersion type heater. Although chemically inert, Teflon™ is a very poor conductor, and therefore, the thermal transfer between the heat source and the fluid is limited. There are currently two configurations of heat exchangers that utilize Teflon™ to maintain both chemical compatibility and purity. The first, and most common configuration, is referred to as an immersion heater. The immersion type heaters utilize large vessels with immersed heating coils that are encased by a chemically inert material such as Teflon™. Because Teflon™ is a relatively poor conductor, a very thin layer of Teflon™ is used in order to minimize the thermal resistance between the heating element and the fluid being heated. Also, in order to increase the thermal transfer to the fluid, it is necessary to maximize the surface area between the heating element and the fluid. Therefore, large lengths of the heating element are packed in a coil arrangement inside the vessel. These coils result in "dead" zones where particles reside and shed over time. This makes the described arrangement less desirable for high purity applications. This is unacceptable because, due to stringent process requirements, etching/cleaning fluids must be free of foreign particles in order to avoid the contamination and destruction of microcircuits formed in the silicon wafers.

Another problem associated with immersion type heaters is related to the geometry of such coils. As the fluid flows across these coils, stagnant regions are formed. These are regions where no fluid flow is present and/or regions where no fluid ever comes in contact with the heating element ("micro bubbles"). Stagnant regions can lead to "hot spots" which are areas where high temperature gradients exist. High temperature gradients can often times degrade the chemical (e.g., lead to premature chemical aging). The combination of hot spots and the micro-bubbles greatly reduce both the efficiency of the heat exchanger and the heating element life, and can also lead to chemical degradation. Another common problem associated with immersion type heat exchangers is that the thin layer of Teflon™ burns immediately when the heating elements become exposed to air. This is a common mode of failure that significantly increases maintenance and parts replacement costs.

Another configuration of heat exchanger currently in use is illustrated in the example of U.S. Pat. No. 5,899,077 issued to Wright, et al., which describes a type of heat exchanger where inert tubing, such as Teflon™ tubing, is sandwiched between thermally conductive rectangular plates. This heat exchanger has been designed to control the temperature of fluids within the room-temperature range. In this configuration, the temperature of the thermally conductive material is controlled via thermoelectric modules. Although thermoelectric modules are useful devices that can cool and heat the conductive material, they are limited to low wattage applications. Hence, this heat exchanger device would not be suitable for heating the common semiconductor etching and cleaning fluids.

Another problem associated with the design described in the prior art listed above, is that it is very difficult to form tight bends in known inert tubing materials. This creates several problems when designing and manufacturing heat exchangers, wherein tubing typically includes multiple bends. First, known inert tubing is easily kinked, and cannot therefore be bent into small diameter bends. Rather, such tubing requires a large bend radius and is, therefore, often bent outside of the heat exchanger, thereby reducing the heating efficiency of the heat exchanger and increasing its size. Further, as the wall thickness of the tubing decreases, the required bend radius increases. Alternatively, if the tubing is entirely retained within the heat exchanger, a complex curved channel with large bend radii must be machined into the conductive plates. In either situation, because of the large bend radii of the plastic tubing, less tubing can be used per unit surface area of the heat exchanger, thereby reducing the thermal efficiency of the heat exchanger and dramatically increasing its size.

In order to compensate for the limited surface area caused by the limited number of bends and limited overall quantity of tubing that can be sandwiched between the rectangular conductive plates, coiled inserts are sometimes placed within the tube. While the turbulence caused by the inserts facilitates increased thermal transfer between the heat exchanger and the fluid, the inserts also cause dead zones within the fluid flow, increasing the potential for particle build-up and contamination of the etching/cleaning fluid. In addition to the coiled inserts, thinner walled inert tubing is often used in order to increase the thermal conduction between the plates and the fluid. While reducing the tubing wall thickness enhances the heat transfer between the conductive plate and fluid, it dramatically reduces the pressure rating of the inert tubing and dramatically increases its bend radius. This severely limits the temperature and pressure ranges within which the heat exchanger can operate, making such solutions unsuitable for many heating applications.

What is needed, therefore, is a heat exchanger design that allows for increased inert tubing surface area while remaining compact. It would also be useful to have a heat exchanger design where no stagnant areas and dead zones exist and/or a heat exchanger that can withstand high pressures at elevated temperatures.

SUMMARY

Accordingly, it is an object of the present invention to provide a heat exchanger which can be used with corrosive fluids.

It is another object of the present invention to provide a heat exchanger which is appropriate for use with fluids wherein purity and cleanliness are essential.

It is yet another object of the present invention to provide a heat exchanger which is compact and efficient.

It is still another object of the present invention to provide a heat exchanger which is rugged and reliable in operation.

It is yet another object of the present invention to provide a heat exchanger which is easy and inexpensive to manufacture.

The present invention allows for the heating of high-purity and/or corrosive fluids by utilizing a cylindrical shaped conductive material with integral spiral shaped channels wherein inert tubing is wrapped. The unit is compact, highly expandable, and inexpensive to produce. This invention can also be used for both heating and cooling and is not limited to high-purity and/or chemically aggressive fluids.

The examples of the particular embodiments of the heat exchanger described include at least one cylindrical shaped thermal reservoir and a tube in thermal contact with the thermal reservoir. The tube is formed from a chemically inert material which is perfluoroalkoxy ("PFA") plastic in this particular example, which has relatively high working temperatures (exceeding 250 degrees Celsius). In the disclosed embodiments, the conductive material is cylindrical in shape with integral spiral shaped grooves.

The spiral channels are arranged such that the pitch (the spacing between channels) is slightly greater than the diameter of the tubing. The spiral shaped channel depth is slightly less than the tubing diameter. According to the present invention, the cylindrical thermal reservoir diameter can be made smaller than the natural bend radius of the tubing.

The thermal reservoir(s) of the various heat exchangers can be heated and/or cooled in a variety of ways. In a particular embodiment, at least one heater is inserted into a machined hole in the thermal reservoir(s). In a more particular embodiment, the heater is a cartridge heater disposed in the thermal reservoirs of the heat exchanger. In an alternate embodiment, thermoelectric chips are coupled to the outside of the thermal reservoir. Optionally, a heat sink can be secured to the thermal reservoir to prevent the thermoelectric chips from overheating, as well as, to regulate the temperature within the thermal reservoir.

In an alternate embodiment, an outer cylindrical shaped thermal reservoir, also containing spiral shaped grooves, is coupled to the outside of the primary thermal reservoir. Standard metallic tubing such as copper or aluminum is placed inside the outer cylinder spiral grooves and is used to carry cold fluids such as refrigerant from a condensing unit or chilled water. The cold fluid is used to thermally regulate the temperature within the primary thermal reservoir.

In yet another alternate embodiment, the cold fluid flows directly though the primary thermal reservoir. This construction eliminates the need for an outer thermal reservoir including the copper tubing.

The fluid conduction tubes of the heat exchange sub-units can be configured in a variety of arrangements. For example, the tubes of adjacent heat exchange sub-units can be connected in series or in parallel. Indeed, the heat exchange sub-units of an expanded heat exchanger can be configured in any combination of series or in parallel groups.

These and other objects and advantages of the present invention will become clear to those skilled in the art in view of the description of modes of carrying out the invention, and the industrial applicability thereof, as described herein and as illustrated in the several figures of the drawing. The objects and advantages listed or discussed herein are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and/or advantages. Accordingly, the listed objects and advantages are not essential elements of the present invention, and should not be construed as limitations.

DETAILED DESCRIPTION OF THE INVENTION

Figure 2:
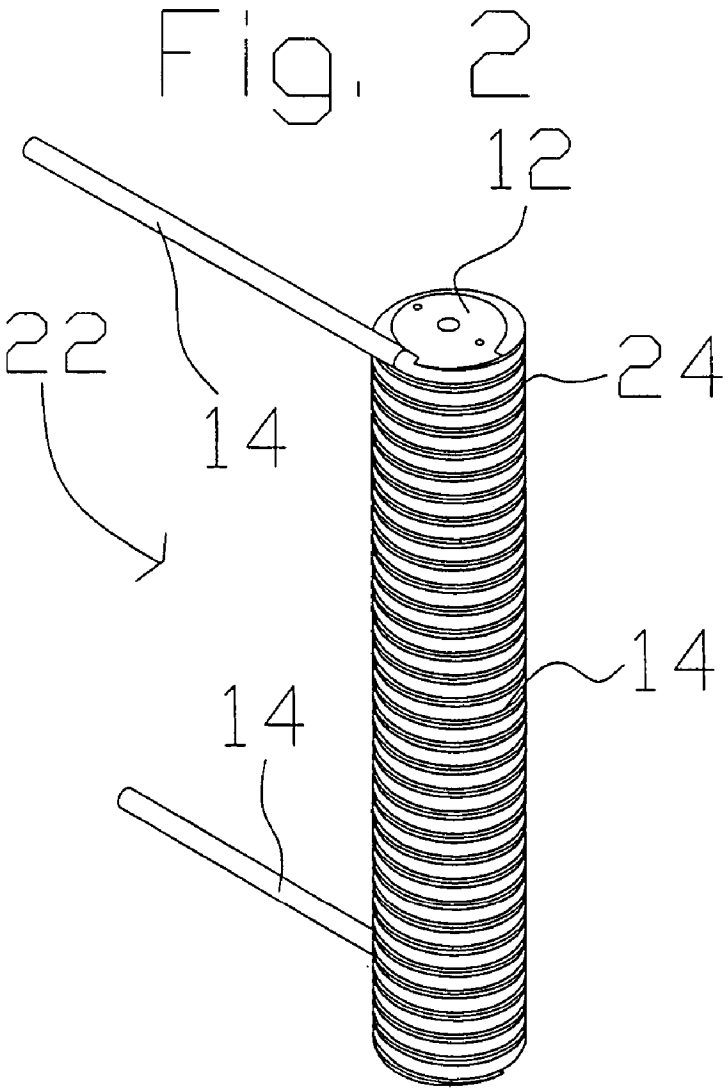
FIG. 2 is a perspective view of the heating block assembly of FIG. 1.

This invention is described in the following description with reference to the Figures, in which like numbers represent the same or similar elements. While this invention is described in terms of modes for achieving this invention's objectives, it will be appreciated by those skilled in the art that variations may be accomplished in view of these teachings without deviating from the spirit or scope of the present invention. The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A known mode for carrying out the invention is a heat exchange apparatus for heating and/or cooling a process fluid. The inventive heat exchange apparatus is depicted in a perspective view in FIG. 1 and is designated therein by the general reference character 10. The heat exchange apparatus 10 has a primary thermally conductive cylinder 12 with process fluid tubing 14 wrapped thereabout. A resistive heating element 15 within the primary thermally conductive cylinder 12 is provided to heat the process fluid tubing 14. In the embodiment described, an outer thermally conductive cylinder 16 has a cooling fluid tubing 18 wrapped thereabout. According to this embodiment excess heat can be drawn from the process fluid tubing 14 through the outer thermally conductive cylinder 16 and into the cooling fluid tubing 18. The cooling fluid tubing 18 is made from a highly heat conductive material, such as copper, in the example shown. A mounting bracket 20 generally encases the heat exchange apparatus 10 and further provides a flat mounting plate portion 21 whereby the heat exchange apparatus 10 can be mounted to an external surface. The assembled combination of the primary thermally conductive cylinder 12 and the process fluid tubing 14 will be referred to hereinafter as a heating block assembly 22.

Figure 1:
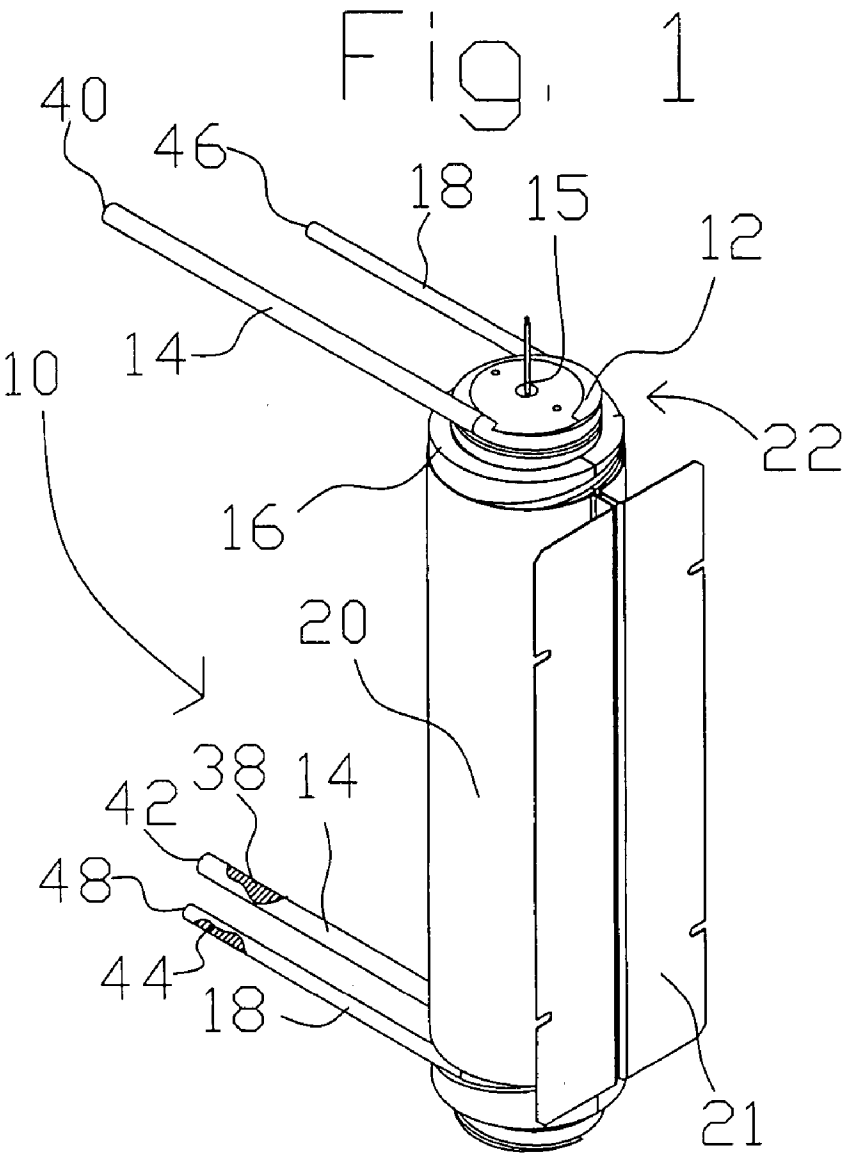
FIG. 1 is a perspective view of a heat exchange apparatus according to one example of the present invention.

FIG. 2 is a perspective view of the heating block assembly 22 of FIG. 1. As can be seen in the view of FIG. 2, the heating block assembly 22 has the process fluid tubing 14 coiled within a spiral groove 24 which is machined into the primary thermally conductive cylinder 12. According to the present example of the invention, the process fluid tubing 14 is made from a generally chemically inert tubing material such as PFA. The spiral groove 24 is sufficiently deep to accept nearly the entire diameter of the process fluid tubing 14. The spiral groove 24 supports the process fluid tubing 14 such that the process fluid tubing can be bent into a tighter coil than its inherent minimum bend radius would allow. Alternatively, the process fluid tubing 14 could be molded into the coil shape, as shown in the view of FIG. 2. Since the process fluid tubing 14 is somewhat elastic, it could be slightly uncoiled to allow it to be place on, or removed from, the primary thermally conductive cylinder 12.

Figure 3:
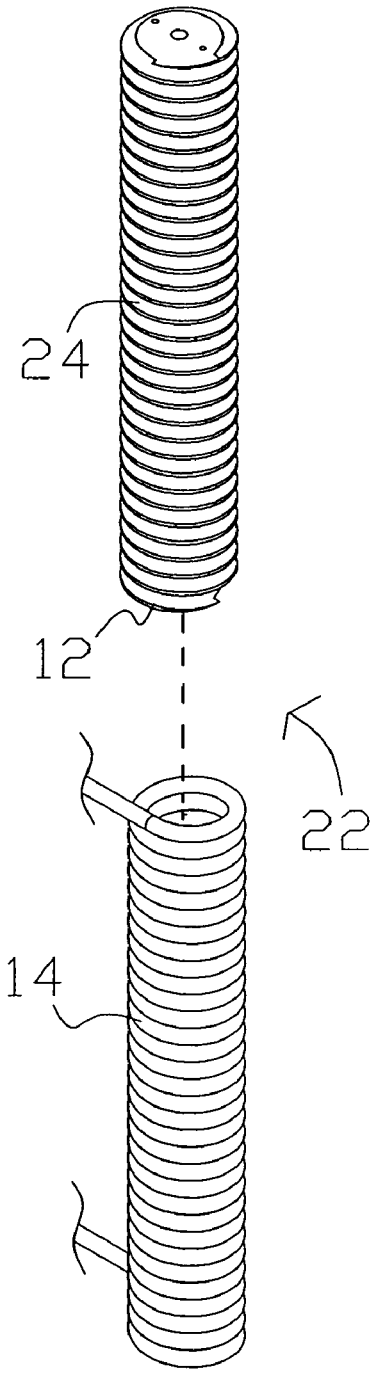
FIG. 3 is an exploded perspective view of the heating block assembly of FIGS. 1 and 2.

FIG. 3 is an exploded perspective view of the heating assembly block 22 showing the process fluid tubing 14 separated from the primary thermally conductive cylinder 12. The closely spaced spiral groove 24 can be seen more clearly in the view of FIG. 3. As can be seen in the view of FIG. 3, in the embodiment shown, the spaces between rotations of the spiral groove 24 are generally somewhat smaller than the diameter of the process fluid tubing 14.

Figure 4:
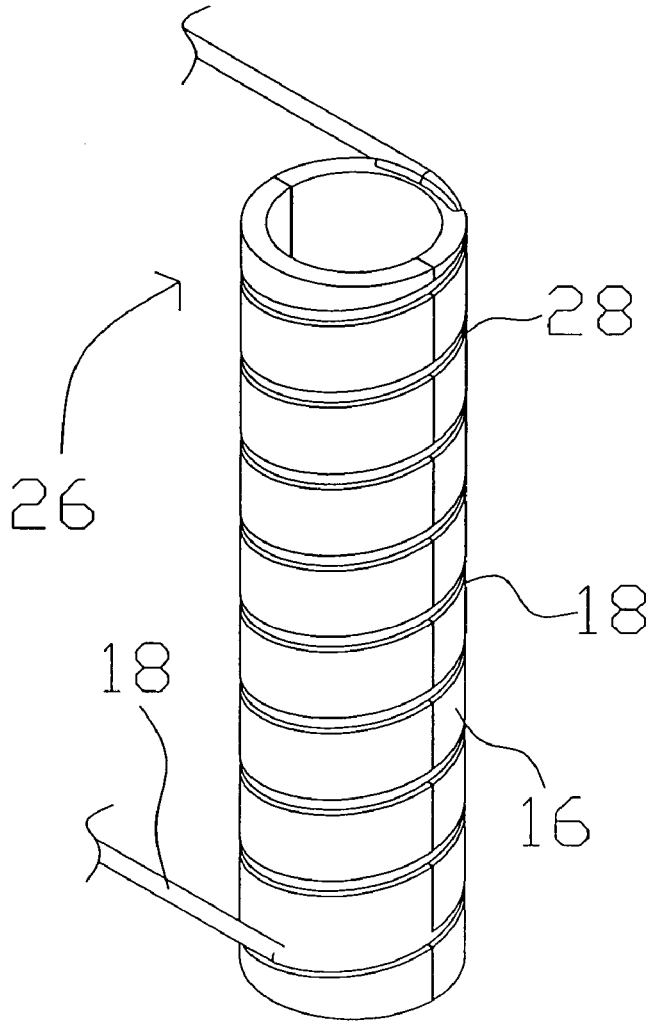
FIG. 4 is a perspective view of the cooling block of FIG. 1.

FIG. 4 is a perspective view of an optional cooling apparatus 26. The cooling apparatus 26 has the cooling fluid tubing 18 wrapped within a secondary spiral groove 28 machined into the outer thermally conductive cylinder 16. As can be seen in the view of FIG. 4, the secondary spiral groove 28 is generally more widely spaced than is the spiral groove 24 as illustrated in FIGS. 2 and 3. The cooling fluid tubing 18 need not be of the non-chemically reactive type, as is the process fluid tubing 14. Generally, the cooling fluid tubing 18 can be made of copper tubing, or the like, which material will readily conduct heat from the outer thermally conductive cylinder 16 into the cooling fluid tubing 18 where it can be removed by a cooling fluid (such as cooled water, a refrigerant fluid, or the like) flowing through the cooling fluid tubing 18.

Figure 5:
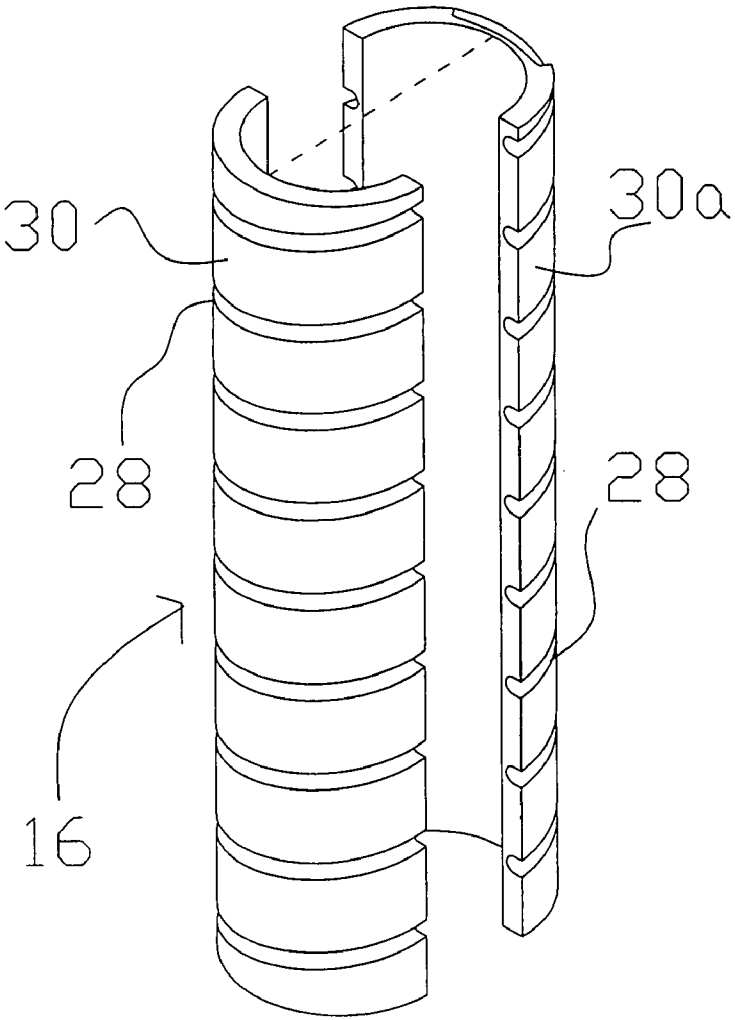
FIG. 5 is an exploded perspective view of the outer thermally conductive cylinder of FIG. 5.

FIG. 5 is an exploded perspective view of the outer thermally conductive cylinder 16, showing that the outer thermally conductive cylinder 16 is formed in two cylinder halves 30 and 30*a* such that the cylinder halves 30 and 30*a* can be put into place around the assembled heating block assembly 22 (FIG. 2) to form the outer thermally conductive cylinder 16.

Figure 6:
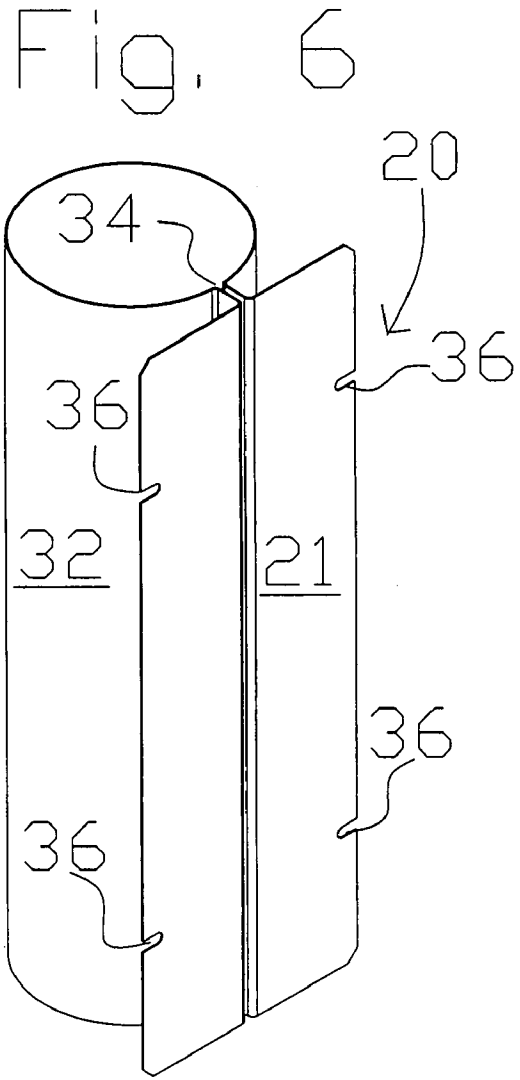
FIG. 6 is a perspective view of the example of the mounting bracket of FIG. 1.

FIG. 6 is a perspective view of the mounting bracket 20 of FIG. 1. As can be seen in the view of FIG. 6, the mounting bracket has a generally cylindrical portion 32 for closely fitting over and supporting the heat exchange apparatus 10. A gap 34 in the cylindrical portion 32 allows the cylindrical portion 32 to be slightly opened to accept the heat exchange apparatus 10. The flat mounting plate portion 21 of the mounting bracket 20 has a plurality of screw slots 36 for mounting the mounting bracket 20 and holding the heat exchange apparatus 10 thereby to a surface. It should be noted that the mounting bracket 20 and, more particularly, the cylindrical portion 32 thereof can be made in a variety of sizes and shapes to accommodate the various alternative embodiments of the invention, some examples of which will be described in more detail hereinafter. It should be noted that the mounting bracket 20 is made from a thermally conductive material and, therefore, also acts as a thermal reservoir.

Referring again to FIG. 1, it should be noted that the above described heat exchange apparatus 10 is capable of selectively heating and/or cooling a process fluid 38 (such as an etching fluid, or the like) which is passed through the process fluid tubing 14 from a process fluid inlet 40 to a process fluid outlet 42. Heating is accomplished by heating the primary thermally conductive cylinder 12, which acts as a thermal reservoir, using the resistive heating element 15. Due to the thermal conductivity nature of the mounting bracket 20 and because it is in thermal contact with the primary thermal reservoir 12, thermal equilibrium is reached during the heating and/or cooling process. Because, according to the present invention, the process fluid tubing 14 has a great deal of surface area in thermal contact with the primary thermally conductive cylinder 12 and, at least in some of the described embodiments, with the mounting bracket 20, heat is readily transferred into the process fluid 38 as the process fluid 38 flows through the process fluid tubing 14. Cooling of the process fluid 38 is accomplished by drawing heat out of the process fluid 38 through the process fluid tubing 14 and into the outer thermally conductive cylinder 16. The outer thermally conductive cylinder 16 is kept cool by a chilled coolant fluid 44 which is introduced through a coolant fluid inlet 46, flows through the cooling fluid tubing 18, and exits from a coolant fluid outlet 48.

Those skilled in the art will understand, of course, that while heat exchange apparatus 10 is capable of both heating and cooling process fluid 38, such heating and cooling would not occur simultaneously. Indeed, primary cylinder 12 and outer cylinder 16 are in thermal contact, and generally in thermal equillibrium during the normal operation of heat exchange apparatus 10. Thus, when cylinder 12 is heated, cylinder 16 is also heated. Similarly, when cylinder 16 is cooled, cylinder 12 is also cooled. Thus, in a simple embodiment, when the heating means are enabled, the cooling means are disabled, and vice versa. However, more precise temperature control can be achieved by using the heating means and cooling means simultaneously. For example, cooling cylinder 16 while cycling heating element 15 prevents overshooting the target temperature.

Figure 7:
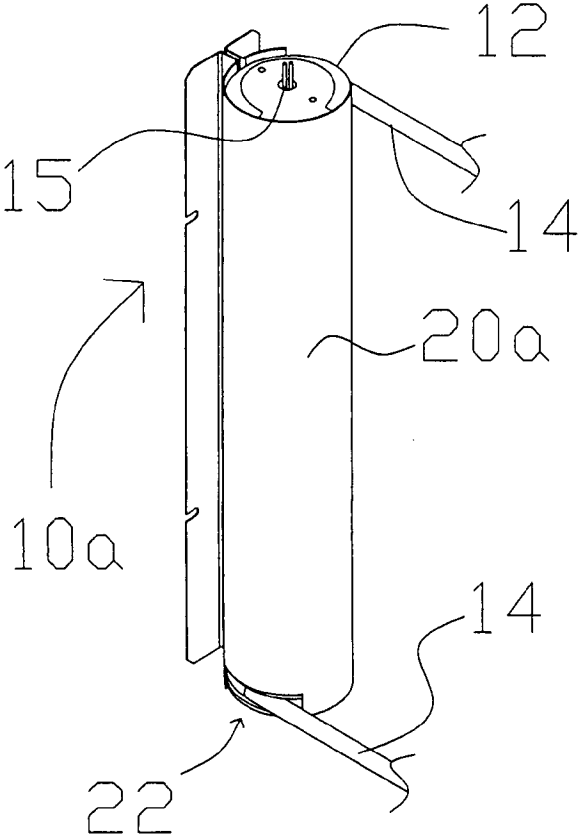
FIG. 7 is a perspective view of an example of an alternate embedment of a heat exchange apparatus according to the present invention, adapted for heating only.

FIG. 7 is an example of a first alternate heat exchange apparatus 10*a* that is intended for heating only, as compared to both heating and cooling. As can be seen in the view of FIG. 7, the primary thermally conductive cylinder 12 and the process fluid tubing 14 are combined, as previously described herein, to form the heating block assembly 22, and the resistive heating element 15 is provided for heating the heating block assembly 22. An alternative mounting bracket 20*a* is provided for accepting and holding in place the first alternative heat exchange apparatus 10*a*.

Figure 8:
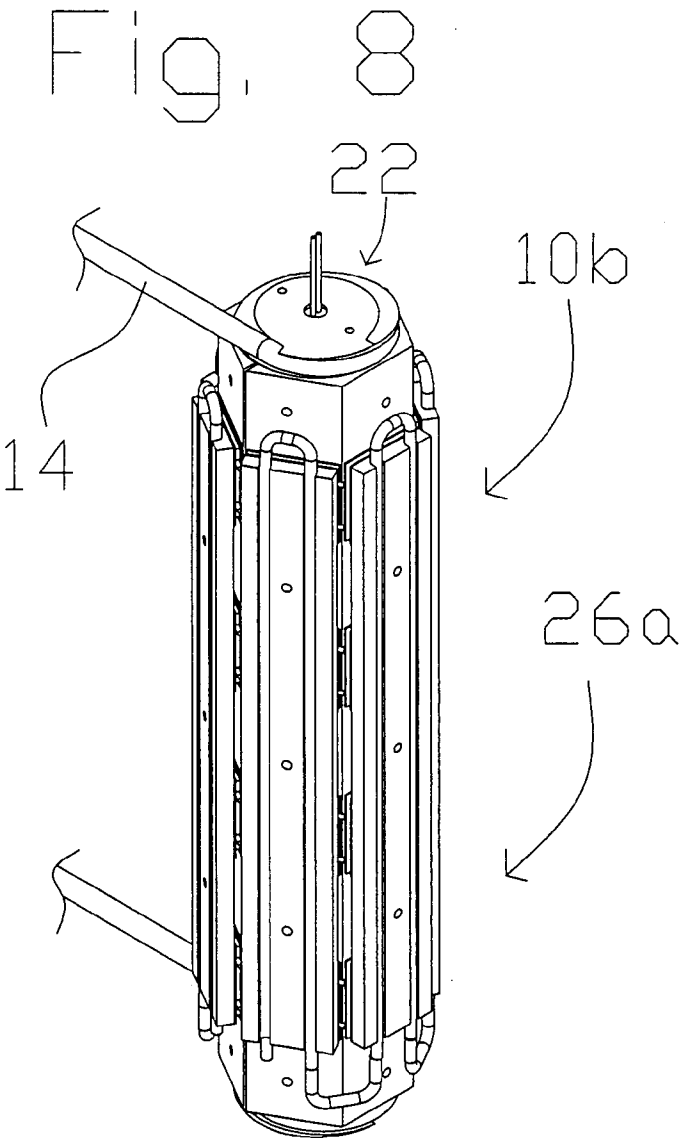
FIG. 8 is a perspective view of yet another example of an alternate embodiment of the heat exchange apparatus, showing a cooling subassembly using thermoelectric modules.
Figure 9:
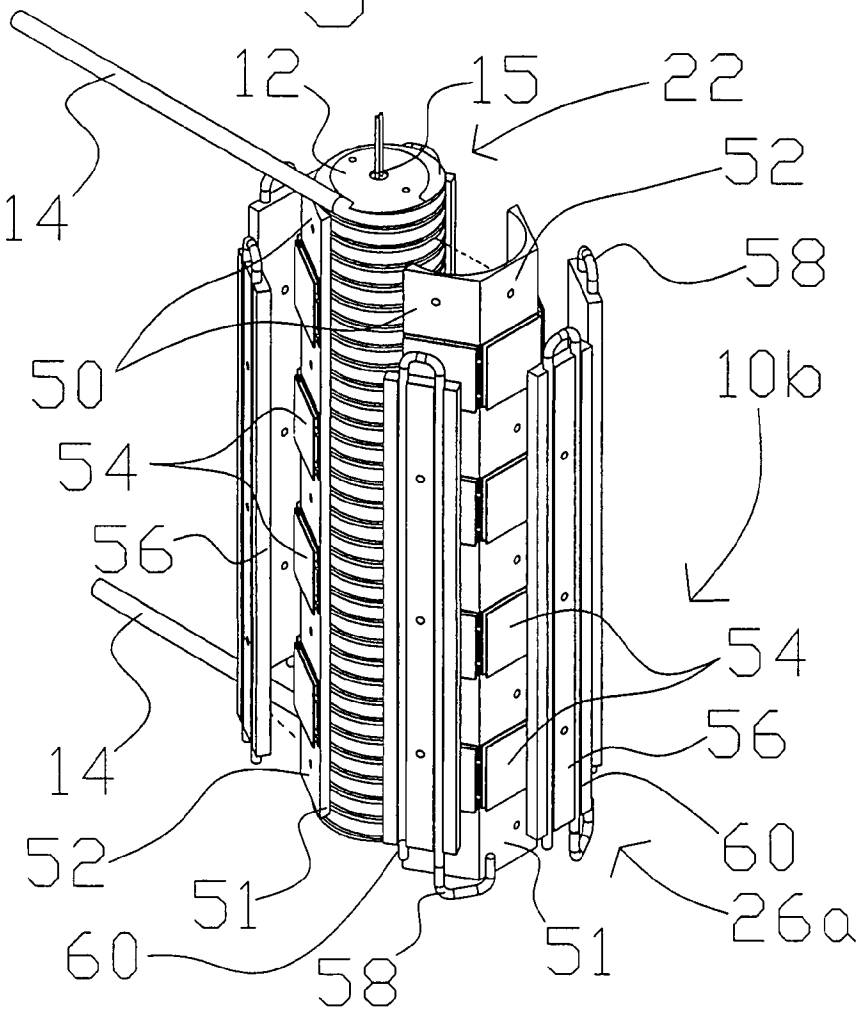
FIG. 9 is an exploded perspective view showing detailed aspects of the alternate embodiment of FIG. 8.

FIG. 8 is an example of a second alternative heat exchange apparatus 10*b*. In the example of FIG. 8 it can be seen that the heating block assembly 22 is surrounded by an alternate cooling apparatus 26*a*. FIG. 9 is an exploded perspective view of the second alternate heat exchange apparatus 10*b* of FIG. 8. In the view of FIG. 9 it can be seen that the alternate cooling apparatus 26*a* has an outer thermal reservoir 50 made up of two outer thermal reservoir halves 51. The outer thermal reservoir 50 is generally round on the inside to provide a close thermal coupling to the heating block assembly 22, and is generally hexagonal on the outside to provide a plurality (six in this example) of flat sides 52 for accepting a plurality (twenty four in this example, of which twelve are visible or partially visible in the view of FIG. 8) of thermoelectric modules 54. The thermoelectric modules are conventional devices with which one skilled in the art will be familiar. When electrical power is applied to the thermoelectric modules 54, heat is drawn from one side (the side in contact with the flat sides 52 of the outer thermal reservoir 50) to the opposite side of the thermoelectric modules 54. It should be noted that wiring to the thermoelectric modules 54 is omitted from the view of FIG. 8 for the sake of clarity.

Since the thermoelectric modules 54 do not have a great capacity for dissipating heat transferred through them, a plurality of outer cooling plates 56 are provided. The outer cooling plates are in direct thermal contact with the thermoelectric modules 54 such that heat is conducted from the thermoelectric modules into the outer cooling plates 56. In the embodiment of the invention shown in FIGS. 8 and 9, a plurality of outer cooling tubes 58 are provided on the outer cooling plates. A cooled fluid is pumped through the outer cooling tubes 58 for cooling the outer cooling plates and thus further enhancing the heat transfer from the process fluid 38 (FIG. 1), through the process fluid tubing 14, the outer thermal reservoir 50, the thermoelectric modules, and the outer cooling plates 56. As can be seen in the view of FIG. 9, a like plurality of outer cooling tube grooves 60 are provided in the outer cooling plates 56, such that the outer cooling tubes 58 fit into the outer cooling tube grooves 60 for increasing the area in thermal contact between the outer cooling plates 56 and the outer cooling tubes 58.

Figure 10:
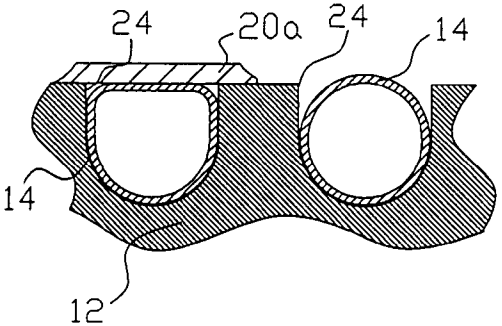
FIG. 10 is a horizontal cross sectional view of the primary thermal conductive cylinder of FIG. 1, showing the groove therein and the pipe placed in the groove.

FIG. 10 is a horizontal cross sectional view of the primary thermal conductive cylinder 12 of FIG. 7, showing the spiral groove 24 therein and the process fluid tubing 14 placed in the spiral groove 24. As can be seen in the view of FIG. 10, the spiral groove 24 is sufficiently deep such that the process fluid tubing 14 fits almost entirely within the spiral groove 24. Further, it should be noted that, in the assembled apparatus, the process fluid tubing 14 is somewhat compressed such that nearly all of the outer surface of the process fluid tubing 14 is in direct thermal contact with the spiral groove 24 and/or the mounting bracket 20*a*. It can be appreciated that in other embodiments, such as the other embodiments described herein, the process fluid tubing 14 will be similarly compressed, and will similarly come into contact with the outer thermally conductive cylinder 16 (FIG. 1), the outer thermal reservoir (FIG. 9), or the like. The fact that such a large portion of the diameter of the process fluid tubing 14 is in thermal contact with the spiral groove 24, the mounting bracket 20, outer thermally conductive cylinder 16, the outer thermal reservoir 50, or the like, combined with the relatively great length of the process fluid tubing 14 considering the compact size of the heat exchange apparatus 10, 10*a*, 10*b*, means that there is a large surface area in direct thermal contact with the thermally conductive masses.

Figure 11:
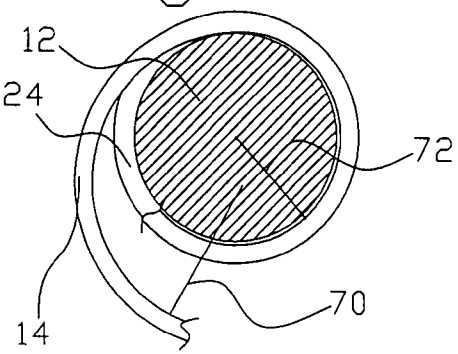
FIG. 11 is a cross sectional view of the primary thermal conductive cylinder of FIG. 1 showing natural and forced bend radii of the tubing.

FIG. 11 is a top cross sectional view of the primary thermal conductive cylinder 12 of FIG. 1 showing a natural bend radius 70 and a forced bend radius 72 of the process fluid tubing 14. It should be noted that the process fluid tubing 14 will have a minimum natural bend radius 70 as an inherent property. If it is attempted to bend the process fluid tubing 14 in a smaller radius than the minimum natural bend radius 70, the result will generally be that the process fluid tubing 14 will kink and/or become partially or fully restricted. However, according to the present invention, the spiral groove 24 provides support such that the process fluid tubing 14 can be bent into the smaller forced bend radius 72, which is the radius of the spiral groove 24 in the primary thermally conductive cylinder 12. This feature means that the heat exchange apparatus 10, 10*a*, 10*b* can be made quite compact while still providing a great quantity of heat transfer surface area, as discussed above.

Figure 12:
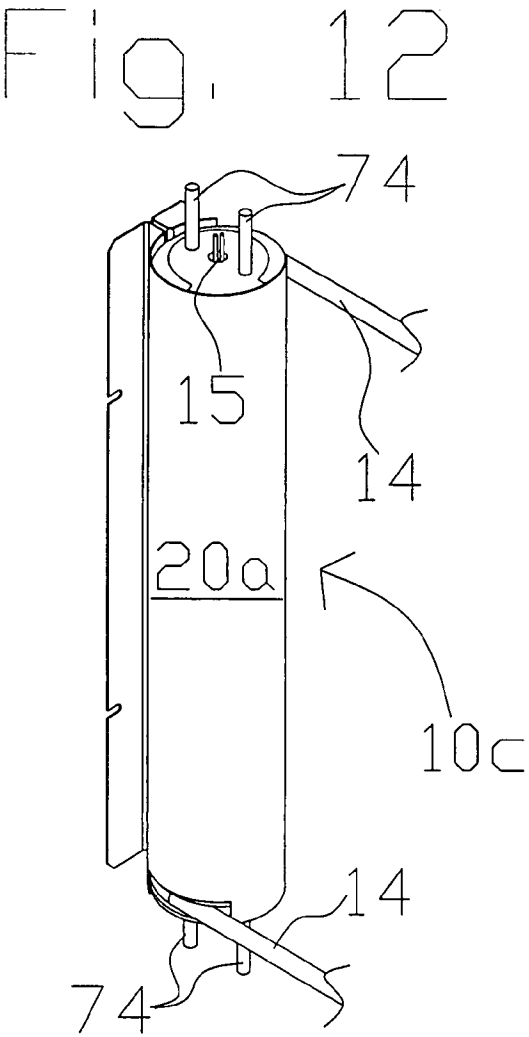
FIG. 12 is a perspective view of yet another example of an alternate embodiment of the heat exchange apparatus according to the present invention.

FIG. 12 is an example of a third alternative heat exchange apparatus 10*c*. In the example of FIG. 12, a plurality (two, in this example) of coolant fluid tubes 74 are provided for passing coolant fluid 44 (FIG. 1) within an alternate primary thermally conductive cylinder 12*a*. The alternate primary thermally conductive cylinder 12*a* is not significantly different from the first described primary thermally conductive cylinder 12 (FIG. 1) except that the alternate primary thermally conductive cylinder 12*a* is provided with through passages for closely accepting the coolant fluid tubes 74. According to this embodiment of the invention, cooling is provided to the process fluid 38 (FIG. 1) by passing the coolant fluid 44 (FIG. 1) through the coolant fluid tubes 74, thereby cooling the thermal mass of the alternate primary thermally conductive cylinder 12*a*, the alternate mounting bracket 20*a*, and the process fluid tubing 14.

Various modifications may be made to the invention without altering its value or scope. For example, the sizes, shapes and quantities of components shown and described in relation to the examples discussed herein could each or all be varied according the needs or convenience of a particular application.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive heat exchange apparatus 10 is intended to be widely used for the heating and/or cooling of fluids used in a great variety of manufacturing processes. A particular use is in the manufacturing processes involved in the production of semiconductor devices, wherein extreme purity is demanded, and further wherein purity is difficult to maintain due in part to the corrosive nature of the process fluids used.

According to the present inventive method, the heat exchange apparatus 10, 10*a*, 10*b*, and others not specifically described in the examples herein, can be made which are small in size, efficient in heat transfer capabilities and which do not include irregularities which could impede the flow of the process fluid 38, thereby causing potential problems as explained in the above description of the prior art.

Figure 13:
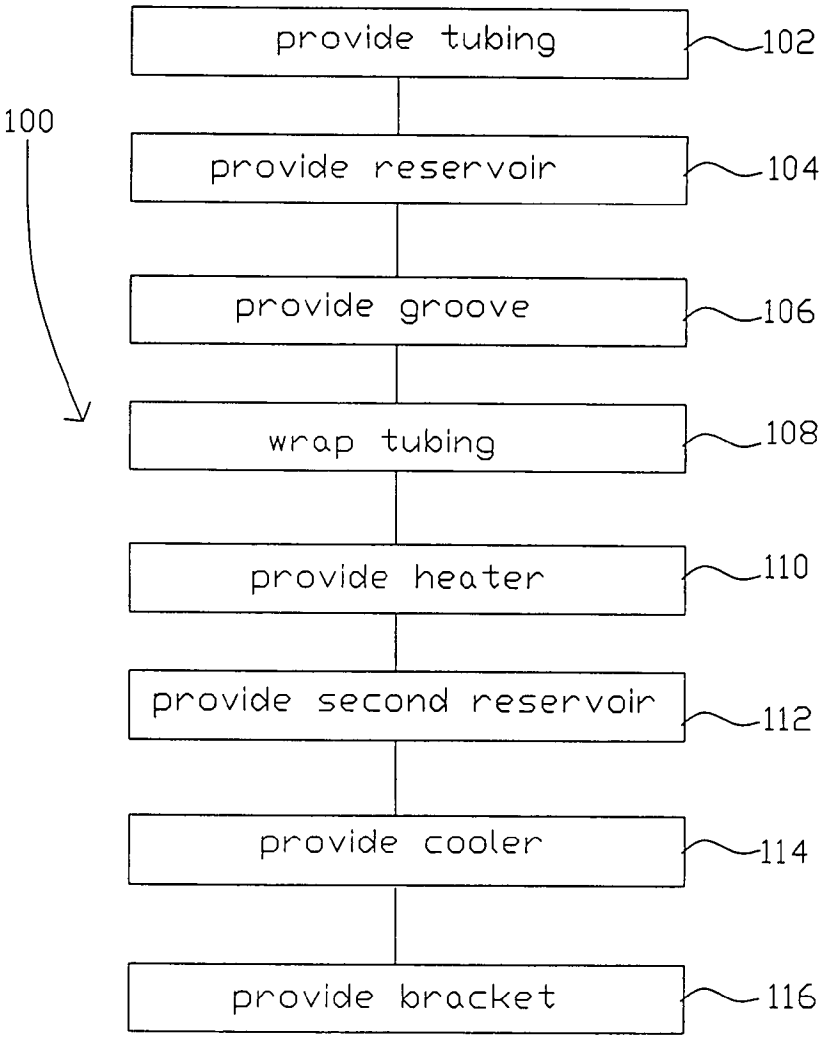
FIG. 13 is a flow diagram depicting an example of the inventive method for constructing a heat exchange apparatus.

FIG. 13 is a flow diagram depicting an example of the inventive heat exchanger manufacturing method 100, whereby the heat exchange apparatus 10, 10*a*, 10*b*, and other examples of the inventive apparatus are produced. In a provide tubing operation 102, the corrosion resistant process fluid tubing 14, as described previously herein, is obtained. In a provide reservoir operation 104 and a provide groove operation 106 the primary thermally conductive cylinder 12 is produced and the spiral groove 24 is created therein. According to the present inventive method 100, the inner radius of the spiral groove 24 can be substantially smaller than the natural (e.g., unsupported) minimum bend radius 70 of the process fluid tubing.

In a wrap tubing operation 108 the process fluid tubing 14 is wrapped in the spiral groove 24. According to the present invention, the process fluid tubing 14 can be ordinary straight tubing having the chemical and physical characteristics discussed herein. However, it is within the scope of the invention that some preforming of the process fluid tubing 14 could also be accomplished whereby the process fluid tubing 14 is formed to conform to the shape of the spiral groove 24. Optionally, and if necessary, the process fluid tubing 14 can be held in place in the spiral groove 24 by an adhesive, or the like.

In a provide heater operation 110, the heating element 15 is provided for heating the heating block assembly 22. In the examples shown herein the heating element 15 is an electric resistive heating element. However, it is within the scope of the invention that other means for heating the heating block assembly 22 could be provided. For example, a heater fluid could be circulated through the heating block assembly 22.

Optionally, in the embodiments of the invention wherein an outer large thermal reservoir, such as the thermally conductive outer cylinder 16 or the outer thermal reservoir 50 is to be used, such is provided in a provide cooling apparatus operation 112. As discussed previously herein, such outer thermal reservoir will have the properties that it is made in sections such that it can be assembled over the outside of the heating block assembly 22, and further it will be constructed such that it is in substantial thermal contact with the heating block assembly 22, preferably both with a substantial portion of the process fluid tubing 14 and also with a substantial portion of the outer surface of the primary thermally conductive cylinder 12.

In a provide cooler operation 114, means for cooling is provided. Cooling can be accomplished by a coolant fluid, thermoelectric means, some combination thereof, or other cooling means such as radiant cooling. Examples shown and described herein are the cooling apparatus 26 and the alternate cooling apparatus 26*a*.

In a provide bracket operation 116, the bracket 20, 20*a* is provided. As discussed previously herein, the bracket 20, 20*a* can be an inherent part of the thermal reservoir system of the heat exchange apparatus 10, 10*a*, 10*b* and 10*c*.

It should be noted that, unless specifically contrary to the instructions provided herein, the order of performing the operations of the inventive heat exchanger manufacturing method 100 is not a necessary aspect of the inventive method.

According to the present inventive method and apparatus, the process fluid tubing 14 comes in contact not only with the grooves 24, but also with the mounting bracket 20, the outer thermally conductive cylinder 16, the outer thermal reservoir 50, or such equivalent as might be used in a particular embodiment. The close thermal coupling between the process fluid tubing 14 and these part ensures that nearly all of the surface area of the process fluid tubing 14 is in thermal contact with a heat transfer surface. Since the mounting bracket 20, 20*a* is also made of a thermally conductive material, the entire heat exchange apparatus 10, 10*a*, 10*b*, 10*c* reaches a thermal equilibrium, thereby insuring that the process fluid tubing 14 and the process fluid 38 therein is uniformly heated and/or cooled.

As described herein, the heat exchange apparatus 10, 10*a*, 10*b* are efficient and economical in operation. The small size of the inventive apparatus is such that examples of the invention can be used in multiple arrangements, either hooked together in series or in parallel, as needed to adjust the temperature, as needed, of the quantity of process fluid 38 required.

Since the heat exchange apparatus 10, 10*a*, 10*b* of the present invention may be readily produced and integrated with existing fluid processing and handling systems, and since the advantages as described herein are provided, it is expected that it will be readily accepted in the industry. For these and other reasons, it is expected that the utility and industrial applicability of the invention will be both significant in scope and long-lasting in duration.

I claim:

1. A fluid temperature control apparatus comprising:

a solid thermal reservoir;

a process fluid tube;

at least one groove formed in said thermal reservoir adapted for closely accepting said process fluid tube such that said process fluid tube is in thermal contact with said groove; and at least one passage formed in said thermal reservoir adapted for carrying a thermal regulating fluid; and wherein said thermal reservoir conducts heat between said passage and a portion of said process fluid tube in thermal contact with said groove.

2. The fluid temperature control apparatus of claim 1, wherein said thermal reservoir is formed from a metallic block.

3. The fluid temperature control apparatus of claim 1, wherein said process fluid tube is made from a corrosive resistant plastic.

4. The fluid temperature control apparatus of claim 3, wherein said process fluid tube is formed from perfluoroalkoxy plastic.

5. The fluid temperature control apparatus of claim 1, wherein said at least one groove is sufficiently deep to accept at least one-half the diameter of said process fluid tube.

6. The fluid temperature control apparatus of claim 1, wherein said at least one groove is formed continuously around the outside of said thermal reservoir.

7. The fluid temperature control apparatus of claim 6, wherein said process fluid tube is continuously wrapped around the outside of said thermal reservoir engaging said at least one groove.

8. The fluid temperature control apparatus of claim 1, further comprising a tube disposed in said at least one passage for carrying said thermal regulating fluid.

9. The fluid temperature control apparatus of claim 1, wherein said at least one passage includes a tube integrally formed in said thermal reservoir.

10. The fluid temperature control apparatus of claim 1, wherein said at least one passage is formed through the interior of said thermal reservoir.

11. The fluid temperature control apparatus of claim 1, farther comprising a second passage formed in said thermal reservoir, said second passage for carrying said thermal regulating fluid.

12. The fluid temperature control apparatus of claim 1, farther comprising a heating apparatus for heating said thermal reservoir.

13. The fluid temperature control apparatus of claim 12, wherein heating apparatus is at least partially enclosed within said thermal reservoir.

14. The fluid temperature control apparatus of claim 13, wherein said heating apparatus is an electric cartridge heater.

15. The fluid temperature control apparatus of claim 1, farther comprising a second thermal reservoir in thermal contact with said thermal reservoir.

16. The fluid temperature control apparatus of claim 15, wherein said second thermal reservoir includes a groove for closely accepting a tube adapted to carry said thermal regulating fluid.

17. The fluid temperature control apparatus of claim 15, wherein said second thermal reservoir includes a flat surface for accepting a heat transfer device.

18. The fluid temperature control apparatus of claim 15, wherein said second thermal reservoir includes at least one thermoelectric heat transfer device.

19. The fluid temperature control apparatus of claim 15, wherein said second thermal reservoir includes a passage for conducting said thermal regulating fluid therethrough.

20. The fluid temperature control apparatus of claim 15, wherein said second thermal reservoir is made in sections such that said second thermal reservoir can be assembled over the outside of said thermal reservoir.

21. The fluid temperature control apparatus of claim 15, farther comprising a mounting bracket having a first portion for enclosing at least a portion of said thermal reservoir and said second thermal reservoir, and a second portion for attaching said fluid temperature control apparatus thereby.

22. The fluid temperature control apparatus of claim 1, farther comprising a mounting bracket having a first portion for enclosing at least a portion of said thermal reservoir and a second portion for attaching said fluid temperature control apparatus thereby.

23. A method for constructing a heat exchange apparatus, comprising:

providing a solid thermal reservoir;

providing a channel in said thermal reservoir;

providing a passage in said thermal reservoir adapted for carrying a thermal regulating fluid; and inserting a process fluid tube in said channel such that said process fluid tube is in close thermal contact with said thermal reservoir; and wherein said thermal reservoir conducts heat between said passage and a portion of said process fluid tube inserted in said channel of said thermal reservoir.

24. The method of claim 23, wherein said step of providing a thermal reservoir includes providing a metallic block.

25. The method of claim 23, wherein said step of providing said process fluid tube includes providing a process fluid tube made from a corrosive resistant plastic.

26. The method of claim 25, wherein said process fluid tube is made from a perfluoroalkoxy plastic.

27. The method of claim 23, wherein said step of providing said channel includes machining said channel into said thermal reservoir.

28. The method of claim 23, wherein said step of providing said channel includes providing a channel that is sufficiently deep to accept at least one-half the diameter of said process fluid tube.

29. The method of claim 23, wherein said step of providing said passage includes machining said passage in said thermal reservoir.

30. The method of claim 23, further comprising inserting a tube in said passage, said tube for carrying said thermal regulating fluid.

31. The method of claim 23, further comprising providing a second passage in said thermal reservoir, said second passage for carrying said thermal regulating fluid.

32. The method of claim 23, wherein said step of providing said passage includes providing said passage through the interior of said thermal reservoir.

33. The method of claim 23, further comprising providing a heating apparatus for heating said thermal reservoir.

34. The method of claim 33, further comprising providing a heater receiving recess in said thermal reservoir, said heater receiving recess for receiving at least a portion of said heating apparatus.

35. The method of claim 34, wherein said step of providing said heating apparatus includes providing a resistive electric heating element.

36. The method of claim 23, further comprising providing a second thermal reservoir.

37. The method of claim 36, further comprising providing a thermal regulating device for regulating the temperature of said second thermal reservoir.

38. The method of claim 37, wherein said step of providing said thermal regulating device includes providing at least one tube adapted to engage said second thermal reservoir and to carry said thermal regulating fluid.

39. The method of claim 37, wherein said step of providing said thermal regulating device includes providing at least one thermoelectric device.

40. The method of claim 37, wherein said step of providing said thermal regulating device includes providing a passage in said thermal reservoir adapted to carry a thermal regulating fluid.

41. The method of claim 36, wherein said step of providing said second thermal reservoir includes providing a thermal reservoir made in sections such that said second thermal reservoir can be assembled over the outside of said thermal reservoir.

42. The method of claim 36, further comprising providing a mounting bracket having a first portion for enclosing at least a portion of said thermal reservoir and said second thermal reservoir, and a second portion for attaching said fluid temperature control apparatus thereby.

43. The method of claim 23, further comprising providing a mounting bracket having a first portion for enclosing at least a portion of said thermal reservoir and a second portion for attaching said fluid temperature control apparatus thereby.

44. A fluid temperature control apparatus comprising:

a solid thermal reservoir;

a process fluid tube;

at least one groove formed in said thermal reservoir adapted for closely accepting said process fluid tube such that said process fluid tube is in thermal contact with said groove;

at least one passage formed in said thermal reservoir adapted for carrying a thermal regulating fluid; and a heating apparatus for heating said thermal reservoir; and wherein said heating apparatus is at least partially enclosed within said thermal reservoir; and said heating apparatus is an electric cartridge heater.

45. A fluid temperature control apparatus comprising:

a solid thermal reservoir;

a process fluid tube;

at least one groove formed in said thermal reservoir adapted for closely accepting said process fluid tube such that said process fluid tube is in thermal contact with said groove;

at least one passage formed in said thermal reservoir adapted for carrying a thermal regulating fluid; and a second thermal reservoir in thermal contact with said thermal reservoir.

46. A fluid temperature control apparatus comprising:

a solid thermal reservoir;

a process fluid tube;

at least one groove formed in said thermal reservoir adapted for closely accepting said process fluid tube such that said process fluid tube is in thermal contact with said groove;

at least one passage formed in said thermal reservoir adapted for carrying a thermal regulating fluid; and a mounting bracket having a first portion for enclosing at least a portion of said thermal reservoir and a second portion for attaching said fluid temperature control apparatus thereby.

47. A method for constructing a heat exchange apparatus, comprising:

providing a solid thermal reservoir;

providing a channel in said thermal reservoir;

providing a passage in said thermal reservoir adapted for carrying a thermal regulating fluid;

inserting a process fluid tube in said channel such that said process fluid tube is in close thermal contact with said thermal reservoir;

providing a heating apparatus for heating said thermal reservoir; and providing a heater receiving recess in said thermal reservoir, said heater receiving recess for receiving at least a portion of said heating apparatus; and wherein said step of providing said heating apparatus includes providing a resistive electric heating element.

48. A method for constructing a heat exchange apparatus, comprising:

providing a solid thermal reservoir;

providing a channel in said thermal reservoir;

providing a passage in said thermal reservoir adapted for carrying a thermal regulating fluid;

inserting a process fluid tube in said channel such that said process fluid tube is in close thermal contact with said thermal reservoir; and providing a second thermal reservoir.

49. A method for constructing a heat exchange apparatus, comprising:

providing a solid thermal reservoir;

providing a channel in said thermal reservoir;

providing a passage in said thermal reservoir adapted for carrying a thermal regulating fluid;

inserting a process fluid tube in said channel such that said process fluid tube is in close thermal contact with said thermal reservoir; and providing a mounting bracket having a first portion for enclosing at least a portion of said thermal reservoir and a second portion for attaching said fluid temperature control apparatus thereby.

* * * * *